US006927404B2

(12) United States Patent
Van den Bergh et al.

(10) Patent No.: US 6,927,404 B2
(45) Date of Patent: Aug. 9, 2005

(54) RADIATION IMAGE STORAGE PANEL HAVING A PARTICULAR LAYER ARRANGEMENT

(75) Inventors: Rudi Van den Bergh, Lint (BE); Thomas Cabes, Lier (BE)

(73) Assignee: AGFA-Gevaert N.V., Mortsel (BE)

( * ) Notice: Subject to any disclaimer, the term of this patent is extended or adjusted under 35 U.S.C. 154(b) by 246 days.

(21) Appl. No.: 10/364,477

(22) Filed: Feb. 11, 2003

(65) Prior Publication Data

US 2003/0160186 A1 Aug. 28, 2003

Related U.S. Application Data

(60) Provisional application No. 60/362,264, filed on Mar. 6, 2002.

(30) Foreign Application Priority Data

Feb. 28, 2002 (EP) ..... 02100195

(51) Int. Cl.[7] ..... H05B 33/00; B05D 5/06; B05D 5/12

(52) U.S. Cl. ..... 250/484.4; 250/484.2; 427/65

(58) Field of Search ..... 250/484.2, 484.4, 250/581, 585; 378/44, 189–190; 430/139, 966–967; 427/65

(56) References Cited

U.S. PATENT DOCUMENTS 4,567,371 A * 1/1986 Ishizuka et al. ..... 250/484.4
5,012,107 A * 4/1991 Kano et al. ..... 250/484.4
5,432,351 A * 7/1995 Pesce et al. ..... 250/486.1
5,466,541 A * 11/1995 Van Havenbergh et al. ..... 250/484.4
5,693,370 A * 12/1997 Van den Zegel ..... 430/517
5,905,014 A * 5/1999 Van de Bergh ..... 250/484.4
6,486,477 B1 11/2002 Suzuki et al. ..... 250/483.1

FOREIGN PATENT DOCUMENTS

EP 0 595 089 4/1994

* cited by examiner

*Primary Examiner*—David Porta
*Assistant Examiner*—Frederick F. Rosenberger
(74) *Attorney, Agent, or Firm*—Joseph T. Guy; Nexsen Pruet, LLC

(57) ABSTRACT

A radiation image storage panel. The panel has a supported layer of storage phosphor particles dispersed in a binding medium, and adjacent thereto, between the layer and a support having reflective properties, a layer arrangement of intermediate layers inbetween the layer and the support. The layer arrangement consists of an antihalation undercoat layer containing one or more dye(s), the layer being situated more close to the support, and an adhesion improving layer situated more close to the layer of storage phosphor particles, and wherein the adhesion improving layer is hardened to a lesser extent than the antihalation undercoat layer.

28 Claims, No Drawings

RADIATION IMAGE STORAGE PANEL HAVING A PARTICULAR LAYER ARRANGEMENT

The application claims the benefit of U.S. provisional application No. 60/362,264 filed Mar. 06, 2002

FIELD OF THE INVENTION

The present invention relates to a radiation image storage panel having, besides a fluorescent layer comprising a binder and a stimulable phosphor dispersed therein, a particular intermediate layer arrangement.

BACKGROUND OF THE INVENTION

In radiography the interior of objects is reproduced by means of penetrating radiation which is high energy radiation belonging to the class of X-rays, γ-rays and high energy elementary particle radiation, e.g. β-rays, electron beam or neutron radiation. For the conversion of penetrating radiation into visible light and/or ultraviolet radiation luminescent substances are used called phosphors.

In a conventional radiographic system an X-ray radiograph is obtained by X-rays transmitted imagewise through an object and converted into light of corresponding intensity in a so-called intensifying screen (X-ray conversion screen) wherein phosphor particles absorb the transmitted X-rays and convert them into visible light and/or ultraviolet radiation whereto a photographic film is more sensitive than to the direct impact of the X-rays. In practice the light emitted imagewise by said screen, whether or not provided with a reflecting layer and/or a fluorescent dye layer in favor of speed or lowering of phosphor coating amount as e.g. in EP-A 0 595 089, irradiates a contacting photographic silver halide emulsion layer film which after exposure is developed to form therein a silver image in conformity with the X-ray image.

As another development described e.g. in U.S. Pat. No. 3,859,527 an X-ray recording system is disclosed wherein photostimulable storage phosphors are used that, in addition to their immediate light emission (prompt emission) on X-ray irradiation, have the property to temporarily store a large part of the energy of the X-ray image which energy is set free by photostimulation in the form of light different in wavelength characteristic from the light used in the photostimulation. In said X-ray recording system the light emitted on photostimulation is detected photo-electronically and transformed in sequential electrical signals.

The basic constituents of such X-ray imaging system operating with storage phosphors are an imaging sensor containing said phosphor, normally a plate or panel, which temporarily stores the X-ray energy pattern, a scanning laser beam for photostimulation, a photo-electronic light detector providing analog signals that are converted subsequently into digital time-series signals, normally a digital image processor which manipulates the image digitally, a signal recorder, e.g. magnetic disk or tape, and an image recorder for modulated light-exposure of a photographic film or an electronic signal display unit, e.g. cathode ray tube. A survey of lasers useful in the read-out of photostimulable latent fluorescent images has been given in the Research Disclosure Volume 308 No. 117 p.991, 1989.

From the preceding description of said two X-ray recording systems operating with X-ray conversion phosphor screens in the form of a plate or panel it is clear that said plates or panels only serve as intermediate imaging elements and do not form the final record. The final image is made or reproduced on a separate recording medium or display. The phosphor plates or sheets provide ability to repeated re-use. Before re-use of the photostimulable phosphor panels or sheets a residual energy pattern is erased by flooding with light.

From the point of view of image quality of the image storage panels, especially with respect to sharpness, the said sharpness does not depend upon the degree of spread of the light emitted by the stimulable phosphor in the panel, but depends on the degree of spread of the stimulable rays in the panel: in order to reduce this spread of light a mixture can be made of coarser and finer batches to fill the gaps between the coated coarser phosphor particles. A better bulk factor may be attained by making a mixture of coarser and finer phosphor grains resulting in a loss in sensitivity unless the said phosphor grains are only slightly different in sensitivity. For intensifying screens this topic has already be treated much earlier by Kali-Chemie and has been patented in U.S. Pat. Nos. 2,129,295; 2,129,296 and 2,144,040. Radiographs showing improved visualisation, comprising therefore a blue-light absorbing (yellow) dye have been described in EP-A 0 028 521.

Especially the phosphor layer thickness can give rise to increased unsharpness of the emitted light, this being the more unfavorable if the weight ratio between the amount of phosphor particles and the amount of binder decreases for the same coating amount of said phosphor particles.

Measures in order to provide sharper images by enhancing the weight ratio amount of phosphor to binder, e.g. by decreasing the amount of binder, however lead to unacceptable manipulation characteristics of the screen, due to insufficient elasticity and brittleness of the coated phosphor layer in the screen.

One way to get thinner coated phosphor layers without changing the coated amounts of pigment and of binder makes use of a method of compressing the coated layer containing both ingredients at a temperature not lower than the softening point or melting point of the thermoplastic elastomer as has been described in EP-A 0 393 662. Another way free from compression manufacturing techniques has been proposed in WO 94/0531, wherein the binding medium comprises one or more rubbery and/or elastomeric polymers providing improved elasticity of the screen, high protection against mechanical damage, high ease of manipulation, high pigment to binder ratio and an improved image quality, especially sharpness. Early references referring to the improvement of sharpness of radiation image storage panels are related with the addition of a colorant to the panels. So in U.S. Pat. No. 4,394,581 a dye or colorant is added to the panel so that the mean reflectance of said panel in the wavelength region of the stimulating rays for said stimulating phosphor is lower than the mean reflectance of said panel in the wavelength region of the light emitted by said stimulable phosphor upon stimulation thereof.

In U.S. Pat. No. 4,491,736 more specifically an organic colorant is disclosed which does not exhibit light emission of longer wavelength than that of the stimulating rays when exposed thereto. So EP-A 0 165 340 and the corresponding U.S. Pat. No. 4,675,271 disclose a storage phosphor screen showing a better image definition by incorporation of a dye. An analoguous effect brought about in phosphor layers of image storage panels by incorporation of dyes or colorants has further been described in EP-A 0 253 348 and the corresponding U.S. Pat. No. 4,879,202 and in EP-A 0 288 038.

In order to further improve image resolution a radiation image storage panel colored with a dye has been disclosed in EP-A 0 866 469 and the corresponding U.S. Pat. No. 5,905,014 having as a characteristic feature that as a colorant a triarylmethane dye having at least one aqueous alkaline soluble group is present in at least one of said the support, the phosphor layer or an intermediate layer between said support and said phosphor layer. As presence of the colorant in the storage phosphor layer may lay burden on screen speed (sensitivity), it is preferred to apply the dye in the intermediate layer between support and phosphor layer and/or in the support only. Presence in the intermediate layer between support and phosphor layer, also called "antihalation undercoat" or "AHU" wherein said support is a reflective support, clearly offers the best relations with respect to speed and sharpness. A disadvantage however resulting from the (mostly obligate) use of differing binder material in both of said storage phosphor and AHU layers is its lack for a perfect adhesion of both layers, more especially in view of manipulation and repeated use (re-use) of storage phosphor panels.

SUMMARY OF THE INVENTION

It has therefore been an object of the present invention to provide a radiation image storage panel showing no disadvantages with respect to adhesion between storage phosphor layer and intermediate AHU layer, providing, besides excellent sharpness without loss in speed, repeated use for a long time, even in severe manutention circumstances. The above-mentioned desired effects have advantageously been realized by providing a radiation image storage panel comprising a supported layer of storage phosphor particles dispersed in a binding medium, and adjacent thereto, between the said layer and a support having reflective properties, a layer arrangement of intermediate layers in between said layer and said support, characterized in that said layer arrangement consists of an antihalation undercoat layer containing one or more dye(s), said layer being situated more close to said support, and an adhesion improving layer situated more close to the said layer of storage phosphor particles, and wherein said adhesion improving layer is hardened to a lesser extent than said antihalation undercoat layer as set out in claim 1.

Specific features for preferred embodiments of the invention are set out in the dependent claims.

Further advantages and embodiments of the present invention will become apparent from the following description.

DETAILED DESCRIPTION OF THE INVENTION

In order to prevent loss in screen speed, besides presence of a reflective support, it is important that there is little or no migration of colorant from the intermediate layer to the storage phosphor layer as migration of dye (colorant) and consequent presence of colorant in the said phosphor layer might cause loss in speed when coated on a support having reflective properties. Hardening of the intermediate AHU layer to a larger extent, although providing less migration of dye present in said AHU layer, however causes adhesion between the more hardened AHU and the storage phosphor layer to become insufficient. According to the present invention a solution was offered by providing a layer arrangement of intermediate layers in between said phosphor layer and said reflective support, characterized in that said layer arrangement consists of an antihalation layer situated more close to said support (preferably being a polyethylene terephthalate—also called "PET"—support) having reflective properties, and an adhesion improving layer situated more close to the phosphor layer, both layers (if taken together) having, in a preferred embodiment according to the present invention, a thickness of from 0.5 $\mu$m up to 20 $\mu$m, and even more preferably, of from 1 $\mu$m up to 10 $\mu$m. Said system has an improving effect on the mechanical poperties of the panel, like binding and cohesive strength, and on the non-migrating properties of the antihalation dye. Said adhesion improving effect by the adhesion improving layer (also called "AIL") was more particularly due to differences in swelling factor and/or solvent solubility of the antihalation layer ("AHU") which should be significantly lower than the swelling factor and/or solvent solubility of the said adhesion improving layer.

The radiation image storage panel according to the present invention preferably has, as a support, a polyethylene terephthalate support having reflective properties in that a light-reflecting layer between a support and a phosphor layer is present or in that light-reflecting particles are incorporated into the support. More preferably a white pigment is incorporated into said support. In case of a light-reflecting layer, the said layer can be provided by vapor-deposition of a metal such as aluminum, lamination of a metal foil such as an aluminum foil, or by coating of a binder solution containing a white powder such as titanium dioxide, barium sulfate or magnesium titanate, without however being limited thereto. The said white powder can also be incorporated into the PET-support. Part of the light travels toward the interface between the phosphor layer and the support (in the opposite direction of the photosensor), whereas the light other than absorbed by or passing through the support is reflected by the support to enter the photosensor and to be converted to electric signals therein. Accordingly, the light to be converted to the electric signals by the photosensor is the sum of the light entering directly therein and the light entering therein after being reflected by the support. The phenomenon that the light emitted by the phosphor particles is absorbed by and/or passes through the support can be prevented by providing a light-reflective support as described above. Providing a light-reflective support brings about adverse influence to the stimulating rays: when part of the stimulating rays pass through the phosphor layer without stimulating the phosphor particles therein and reach the light-reflective support, the stimulating rays are reflected by the support to spread widely within the phosphor layer. As the result, both the target phosphor particles and the phosphor particles present outside thereof are stimulated, thereby causing decrease of the sharpness of the resulting image, obtained by converting the light emitted by these phosphor particles to the electric signals and reproducing therefrom. Presence of an "AHU", provided with a dye, carefully chosen in order to absorb stimulating rays as set forth above, however avoids scattering of stimulating radiation and loss in image definition. The antihalation dye(s), applied in the antihalation layer, should have a maximum absorption wavelength of 633+/−35 nm, 633 nm being the emission wavelength of the HeNe-laser; a molar extinction coëfficient of at least 50000; no substantial absorption at the emission wavelength of the stimulable phosphor, being 390–400 nm; and a negligible appearance of J-aggregation. Preferred dyes are from the class of leuco indoanilines, merostyryl azomethines, azoanilines, etc. More particularly preferred is the dye or colorant in the AHU-layer, used in the examples hereinafter, the formula of which is given therein, without however being limited thereto.

In a more preferred embodiment according to the present invention both layers forming the intermediate layer arrangement of at least two layers as set out hereinbefore, have the same (polymeric) binder material. The said polymeric binder of both layers preferably consists of soluble polymers or curable monomers and oligomers selected from the group consisting of polyester acrylates, urethane modified polyesters, urethane acrylates, vinyl acetates, melamine-formaldehyd resins, polyisocyanates, thermoplastic rubbers, epoxidized hetero-telechelic polymers, polyvinyl alcohols and siloxanes.

So in the radiation image storage panel according to the present invention, the solvent solubility of the antihalation layer is less than 1%, whereas the mass swelling factor increase is less than 20%, said factor having been determined after immersing for 10 minutes at 25° C. a sample of 5×5 cm of said panel in a solvent mixture of methyl-cyclohexane/toluene/butyl acetate present in a ratio of 50/30/20, wherein said ratio is expressed in weight % (wt %). Said solvent solubility of the antihalation layer (AHU), expressed in % is determined from a separate coating of an AHU onto a support, wherein said AHU is cured to the same extent as in the radiation panel.

Otherwise,in the radiation image storage panel according to the present invention the solvent solubility of the adhesion improving layer is more than 3%, whereas the mass swelling factor increase is more than 20%, said factor having been determined after immersing for 10 minutes at 25° C. a sample of said panel in a solvent mixture of methyl-cyclohexane/toluene/butyl acetate present in a 50/30/20 wt % ratio. Said solvent solubility of the adhesion improving layer (AIL), expressed in % is determined again from a separate coating of an AIL onto a support, wherein said AIL is cured to the same extent as in the radiation panel.

The radiation image storage panel according to the present invention is consequently characterized by a solvent solubility of the adhesion improving layer (AIL) of more than 3%, whereas the mass swelling factor increase is more than 20%, said increase having been determined in the same way in the same solvent mixture as described hereinbefore.

The solvent combination described hereinbefore has been chosen in order to perform the tests in the examples described hereinafter and in order to characterize the relative properties of both partial layers (AIL and AHU) of the intermediate layer arrangement in between support and storage phosphor layer.

According to the present invention in said panel preferred ratios of said swelling factor between AIL and AHU are in the range from at least 11:10 up to 10:1, more preferably from 2:1 up to 5:1, said factor having been determined after immersing a sample of 5 cm×5 cm of the storage phosphor panel for 10 minutes at 25° C. in a solvent mixture of methyl-cyclohexane/toluene/butyl acetate in a 50/30/20 wt % ratio, thus in the same solvent as in the solubility test hereinbefore. Calculation of changes in thickness of both layers, as measured by microscopic techniques, can also provide said ratios of swelling factor, which should be understood as expressing the relative increase in thickness of both partial layers.

In a further preferred embodiment the radiation image storage panel according to the present invention is characterized by a "cross-cut" value, which is significantly better for the image storage panel with a multilayer arrangement of intermediate layers, if compared with the comparative radiation image storage panel, having only one layer in between said reflective support and said storage phosphor layer.

For a radiation image storage panel according to the present invention a "cross-cut" value of not more than 20% is obtained, when applied to the said layer arrangement as described in DIN 53151.

As a further characteristic, according to the present invention, the radiation image storage panel preferably shows a non-migration percentage of antihalation dye or colorant, determined after having been cured for 30 minutes at 90° C., of at least 95% for the antihalation layer, and at least 90% for the intermediate two-layer arrangement, wherein optical densities of the "AHU" and "AHU+AIL" respectively are measured before and after immersion for 10 minutes in the same solvent combination as applied before and wherein said percentage has been calculated from ratios of optical densities thus measured.

According to the present invention a radiation image storage panel has thus been provided, wherein an antihalation undercoat layer (AHU) is comprising one or more dye(s) providing in said antihalation undercoat layer with an average absorption coefficient being higher in the wavelength range of the stimulating rays than in the wavelength range of the rays emitted by the stimulable phosphor upon stimulation, wherein a non-migration percentage of the antihalation dye(s) is at least 95% for the antihalation layer, and at least 90% for the layer arrangement (AHU+AIL), both having been cured for 30 minutes at 90° C., said percentage having been determined after immersing for 10 minutes a sample of the panel in a solvent mixture at 25° C. of methylcyclohexane/toluene/butylacetate present in a 50/30/20 wt % ratio.

As a result the radiation image storage panel, comprising a supported layer of storage phosphor particles dispersed in a binding medium, and adjacent thereto, between the storage phosphor layer and the polyethylene terephthalate support having reflective properties, an intermediate multilayer arrangement of two layers, one being the (sharpness enhancing) antihalation layer (AHU), the other being an adhesion improving layer (AIL), wherein said layers have a thickness from 0.5 $\mu$m up to 20 $\mu$m and wherein said layer arrangement provides an improving effect on the mechanical properties of the panel, like binding and cohesive strength, thus allows frequent re-use, even in circumstances of severe manipulation and frequent use, further avoiding loss in speed, thanks to non-migrating properties of the antihalation dye(s) present in the well-cured AHU layer.

According to the present invention a method has been provided for preparing a radiation image storage panel as described before, wherein the said layer arrangement (AHU+AIL) has been coated by means of a coating technique selected from the group consisting of doctor blade or dip-coating, screen printing and spraying and wherein curing of said layer arrangement has been performed by means of a curing technique selected from the group consisting of thermal curing, UV/EB(electron beam)-curing and solvent evaporation.

A short review of important parameters dealt with before and applied in the following examples is given hereinafter.

The degree of curing of the antihalation undercoat (AHU) and adhesion improving layer (AIL) has, in the context of the present invention, been observed by parameters as "dye-migration", "swelling factor" and "solvent solubility".

"Dye migration" has been determined by comparing the optical density of the AHU-layer or the AHU+AIL layer arrangement before and after immersion of the layer(s) in the described solvent mixture.

The "swelling factor" is determined by weight or, in the alternative, by surface increase. The mass swelling degree or increase by mass of a layer sample is determined after immersion in a solvent for 10 min. at a temperature of 25° C. The "swelling factor" of a layer in a complete radiation image storage panel layer arrangement is determined by measuring (with a microscope) the increase in thickness of the cross-section surface area for the layer to be determined, after having immersed a sample of said panel in the solvent for a time and at a constant temperature given above.

The mechanical properties of the panel have further been determined by a "cross-cut"-test (defined as DIN53151—ISO 2409—ASTM D 3359—NBN T22-107 standard), wherein, after application of the "cross-cut" (with test instrument 1542M0003 Braive Instruments Belgium), a tape (TESA-tape 4324) has been applied and pulled off in order to make interpretation of the binding and cohesive strength possible.

In the phosphor layer of the storage panel according to the present invention an increase in the volume ratio of phosphor to binder further provides a reduction of the thickness of the coating layer for an equal phosphor coverage and in addition not only provides a better sharpness but also offers a higher speed or sensitivity. An extra improvement in image-sharpness can be realized with the thermoplastic rubber binders cited in WO94/0531 because thinner phosphor layers are possible at a higher phosphor to binder ratio. Rubbery binders are preferably chosen because they allow a high volume ratio of pigment to binder, resulting in excellent physical properties and image quality and in an enhanced speed. In that case a small amount of binding agent does not result in too brittle a layer and minimum amounts of binder in the phosphor layer provide enough structural coherence to the layer. Especially for storage phosphor members this factor is very important in view of the manipulations said member is exposed to. The weight ratio of phosphor to binder preferably from 80:20 to 99:1. The ratio by volume of phosphor to binding medium is preferably more than 85/15. In this connection a volume ratio of phosphor to binder higher than 92/8 is hardly allowable and is about a maximum value of said volume ratio. A mixture of one or more thermoplastic rubber binders may be used in the coated phosphor layer(s): preferably the binding medium substantially consists of one or more block copolymers, having a saturated elastomeric midblock and a thermoplastic styrene endblock, as rubbery and/or elastomeric polymers as disclosed in WO 94/00530. Particularly suitable thermoplastic rubbers, used as block-copolymeric binders in phosphor screens in accordance with the present invention are the KRATON-G rubbers, KRATON known as a trade mark name from SHELL, The Netherlands. The phosphor layer preferably has a bound polar functionality of at least 0.5%, a thickness in the range from 10 to 1000 μm and a ratio by volume of 92:8 or less.

Storage panels as described hereinbefore, according to the present invention, may be provided with at least one antioxidant preventing yellowing of the screen. The antioxidant (s) is(are) preferably incorporated in the phosphor layer. The coating dispersion may further contain a filler (reflecting or absorbing).

As is well-known the sensitivity of the screen is determined by the chemical composition of the phosphor, its crystal structure and crystal size properties and the weight amount of phoshor coated in the phosphor layer. The image quality, particularly sharpness, especially depends on optical scattering phenomena in the phosphor layer being determined mainly besides the already mentioned thickness of the phosphor layer by the packing density. Said packing density of the phosphor particles depends on the crystal size distribution of the phosphor particles, their morphology and the amount of binder present in the phosphor layer or layers.

Another factor determining the sensitivity of the screen is the thickness of the phosphor layer, being proportional to the amount of phosphor(s) coated. Said thickness may be within the range of from 10 to 1000 μm, preferably from 50 to 500 μm and more preferably from 100 to 300 μm.

The coverage of the phosphor or phosphors present as a sole phosphor or as a mixture of phosphors whether or not differing in chemical composition and present in one or more phosphor layer(s) in a screen is preferably in the range from about 50 to 2500 g/m$^2$, more preferably from 200 to 1750 g/m$^2$ and still more preferably from 300 to 1500 g/m$^2$. Said one or more phosphor layers may have the same or a different layer thickness and/or a different weight ratio amount of pigment to binder and/or a different phosphor particle size or particle size distribution. It is general knowledge that sharper images with less noise are obtained with phosphor particles of smaller mean particle size, but light emission efficiency declines with decreasing particle size. Thus, the optimum mean or average particle size for a given application is a compromise between imaging speed and image sharpness desired. Preferred average grain sizes of the phosphor particles are in the range of 2 to 30 μm and more preferably in the range of 2 to 20 μm.

In the phosphor layer(s), any phosphor or phosphor mixture may be coated depending on the objectives that have to be attained with the manufactured storage phosphor screens. Besides mixing fine grain phosphors with more coarse grain phosphors in order to increase the packing density, a gradient of crystal sizes may, if required, be build up in the storage panel. Principally this may be possible by coating only one phosphor layer, making use of gravitation forces, but with respect to reproducibility at least two different storage panels coated from phosphor layers comprising phosphors or phosphor mixtures in accordance with the present invention may be coated in the presence of a suitable binder, the layer nearest to the support consisting essentially of small phosphor particles or mixtures of different batches thereof with an average grain size of about 5 μm or less and thereover a mixed particle layer with an average grain size from 8 to 20 μm for the coarser phoshor particles, the smaller phosphor particles optionally being present as interstices of the larger phosphor particles dispersed in a suitable binder. Depending on the needs required the stimulable phosphors in accordance with the present invention or mixtures thereof may be arranged in a variable way in these coating constructions.

It is clear that within the scope of the present invention the choice of the phosphor(s) or phosphor mixture(s) is limited in that the radiation image storage panel has a wavelength region of the stimulating rays situated between 500 and 700 nm. Further in a preferred embodiment according to the present invention said radiation image storage panel has a wavelength region of the light emitted by said stimulable phosphor upon stimulation thereof situated between 350 and 450 nm.

In radiation image storage panels according to the present invention e.g. divalent europium-doped bariumfluorohalide phosphors may be used, wherein the halide-containing portion may be (1) stoichiometrically equivalent with the fluorine portion as e.g. in the phosphor described in U.S. Pat. No. 4,239,968,
(2) may be substoichiometrically present with respect to the fluorine portion as described e.g. in EP-A 0 021 342 or 0 345 904 and U.S. Pat. No. 4,587,036, or
(3) may be superstoichiometrically present with respect to the fluorine portion as described e.g. in U.S. Pat. No. 4,535,237.

So according to U.S. Pat. No. 4,239,968 a method is claimed for recording and reproducing a radiation image comprising the steps of (i) causing a visible ray- or infrared ray-stimulable phosphor to absorb a radiation passing through an object, (ii) stimulating said phosphor with stimulation rays selected from visible rays and infrared rays to release the energy of the radiation stored therein as fluorescent light, characterized in that said phosphor is at least one phosphor selected from the group of alkaline earth metal fluorohalide phosphors.

From the stimulation spectrum of said phosphors it can be learned that said kind of phosphor has high sensitivity to stimulation light of a He—Ne laser beam (633 nm) but poor photostimulability below 500 nm. The stimulated light (fluorescent light) is situated in the wavelength range of 350 to 450 nm with a peak at about 390 nm (ref. the periodical Radiology, September. 1983, p.834.).

It can be learned from said U.S. Pat. No. 4,239,968 that it is desirable to use a visible ray (e.g. red light) stimulable phosphor rather than an infra-red ray-stimulable phosphor because the traps of an infra-red-stimulable phosphor are shallower than these of the visible ray-stimulable phosphor and, accordingly, the radiation image storage panel comprising the infra-red ray-stimulable phosphor exhibits a relatively rapid dark-decay (fading). For solving that problem it is desirable as explained in U.S. Pat. No. 4,239,968 to use a photostimulable storage phosphor which has traps as deep as possible to avoid fading and to use for emptying said traps light rays having substantially higher photon energy (rays of short wavelength).

Attempts have been made to formulate phosphor compositions showing a stimulation spectrum in which the emission intensity at the stimulation wavelength of 500 nm is higher than the emission intensity at the stimulation wavelength of 600 nm. A phosphor for said purpose, also suitable for use in the storage panel of the present invention has been described in U.S. Pat. No. 4,535,238 in the form of a divalent europium activated barium fluorobromide phosphor having the bromine-containing portion stoichiometrically in excess of the fluorine. According to U.S. Pat. No. 4,535,238 the photostimulation of the phosphor can proceed effectively with light, even in the wavelength range of 400 to 550 nm.

Although $BaFBr:Eu^{2+}$ storage phosphors, used in digital radiography, have a relatively high X-ray absorption in the range from 30–120 keV, which is a range relevant for general medical radiography, the absorption is lower than the X-ray absorption of most prompt-emitting phosphors used in screen/film radiography, like e.g. LaOBr:Tm, $Gd_2O_2S$:Tb and $YTaO_4$:Nb. Therefore, said screens comprising light-emitting luminescent phosphors will absorb a larger fraction of the irradiated X-ray quanta than BaFBr:Eu screens of equal thickness. The signal to noise ratio (SNR) of an X-ray image being proportional to the square-root of the absorbed X-ray dose, the images made with the said light-emitting screens will consequently be less noisy than images made with BaFBr:Eu screens having the same thickness. A larger fraction of X-ray quanta will be absorbed when thicker BaFBr:Eu screens are used. Use of thicker screens, however, leads to diffusion of light over larger distances in the screen, which causes deterioration of image resolution. For this reason, X-ray images made with digital radiography, using BaFBr screens, as disclosed in U.S. Pat. No. 4,239,968, give a more noisy impression than images made with screen/film radiography. A more appropriate way to increase the X-ray absorption of phosphor screens is by increasing the intrinsic absorption of the phosphor. In BaFBr:Eu storage phosphors suitable for use in the present invention this is advantageously achieved by partly substituting bromine by iodine. BaFX:Eu phosphors containing large amounts of iodine as e.g. been described e.g. in EP-A 0 142 734 are also suitable for use in panels according to the present invention. The relative luminance of the storage phosphor should be as high as possible, and since the sensitivity of a storage phosphor system is proportional to the storage phosphor luminance and apart from a high X-ray absorption, a high sensitivity of the system thus developed is essential for reducing image noise. Therefore, in a phosphor as disclosed in EP-A 0 142 734, the gain in image quality, due to the higher absorption of X-rays when more than 50% of iodine is included in the phosphor is offset by the lowering of the relative luminance.

Divalent europium activated barium fluorobromide phosphors suitable for use in panels according to the present invention have further been described in EP-A 0 533 236 and in the corresponding U.S. Pat. Nos. 5,422,220 and 5,547,807. In the said EP-A 0 533 236 a divalent europium activated stimulable phosphor is claimed wherein the stimulated light has a higher intensity when the stimulation proceeds with light of 550 nm, than when the stimulation proceeds with light of 600 nm. It is said that in said phosphor a "minor part" of bromine is replaced by chlorine and/or iodine. By minor part has to be understood less than 50 atom %.

Still other divalent europium activated barium fluorobromide phosphors suitable for use in the panel according to the present invention have been described in EP-A 0 533 234. In this EP-A 0 533 234 a process is described to prepare europium-doped alkaline earth metal fluorobromide phosphors, wherein fluorine is present in a larger atom % than bromine, and which have a stimulation spectrum that is clearly shifted to the shorter wavelength region. Therein use of shorter wavelength light in the photostimulation of phosphor panels containing phosphor particles dispersed in a binder is in favor of image-sharpness since the diffraction of stimulation light in the phosphor-binder layer containing dispersed phosphor particles acting as a kind of grating will decrease with decreasing wavelength. As is apparent from the examples in this EP-A 0 533 234 the ultimately obtained phosphor composition determines the optimum wavelength for its photostimulation and, therefore, the sensitivity of the phosphor in a specific scanning system containing a scanning light source emitting light in a narrow wavelength region.

Other preferred photostimulable phosphors according to the applications mentioned hereinbefore contain an alkaline earth metal selected from the group consisting of Sr, Mg and Ca with respect to Ba in an atom percent in the range of $10^{-1}$ to 20 at %. From said alkaline earth metals Sr is most preferred for increasing the X-ray conversion efficiency of-the phosphor. Therefore in a preferred embodiment strontium is recommended to be present in combination with barium and fluorine stoichiometrically in larger atom % than bromine alone or bromine combined with chlorine and/or iodine.

Still other preferred photostimulable phosphors suitable for use in the panel according to the present invention contain a rare earth metal selected from the group consisting of Ce, Pr, Nd, Gd, Tb, Dy, Ho, Er, Tm, Yb and Lu with respect to Ba in an atom percent in the range of $10^{-3}$ to $10^{-1}$ at %. From said rare earth metals Gd is preferred for obtaining a shift of the maximum of the photostimulation spectrum of the phosphor to the shorter wavelengths. The preferred phosphors of the application referred to hereinbefore are also preferred for use in the present invention provided that, as set forth hereinbefore, the wavelength region of the stimulating rays is between 500 and 700 nm.

Furtheron still other preferred photostimulable phosphors suitable for use in the panel according to the present invention contain a trivalent metal selected from the group consisting of Al, Ga, In, Tl, Sb, Bi and Y with respect to Ba in an atom % in the range of $10^{-1}$ to 10 at %. From said trivalent metals Bi is preferred for obtaining a shift of the maximum of the photostimulation spectrum of the phosphor to the shorter wavelengths. Preferred phosphors for use according to this invention are further phosphors wherein fluorine is present stoichiometrically in a larger atom % than bromine taken alone or bromine combined with chlorine and/or iodine, e.g. fluorine is present in 3 to 12 atom % in excess over bromine or bromine combined with chlorine and/or iodine.

Still other particularly suitable barium fluorobromide phosphors for use in panels according to the present invention contain in addition to the main dopant $Eu^{2+}$ at least Sm as codopant as described in EP-A 0 533 233 and in corresponding U.S. Pat. No. 5,629,125. Still other useful phosphors suitable for use in panels of the present invention are those wherein Ba-ions are partially replaced by Ca-ions at the surface of the phosphors as in EP-A 0 736 586.

In digital radiography it may be advantageous to use photostimulable phosphors that can very effectively be stimulated by light with a wavelength higher than 600 nm as for phosphors included for use in storage panels according to the present invention, since then the choice of small reliable lasers that can be used for stimulation (e.g. He—Ne, semi-conductor lasers, solid state lasers, etc) is very great so that the laser type does not dictate the dimensions of the apparatus for reading (stimulating) the stimulable phosphor screen. It is clear however that the choice of the dye, present in the AHU-layer should be adapted to the wavelength of the stimulating light source. So more recently stimulable phosphors, giving a better signal-to-noise ratio, a higher speed, further being stimulable at wavelengths above 600 nm have therefore been described in EP-A 0 835 920 and the corresponding U.S. Pat. Nos. 5,853,946 and 6,045,722. Therein a storage phosphor class has been described providing high X-ray absorption, combined with a high intensity of photostimulated emission, thus allowing to build a storage phosphor system for radiography yielding images that have at the same time a high sharpness and a low noise content, through a decreased level of X-ray quantum noise and a decreased level of fluorescence noise. Further said class of photostimulable phosphors provides a high X-ray absorption, combined with a high intensity of photostimulated emission, showing said high intensity of photostimulated emission when stimulated with light having a wavelength above 600 nm. Said photostimulable phosphors can further be used in panels for medical diagnosis, whereby the dose of X-ray administered to the patient can be lowered and the image quality of the diagnostic image enhanced: in a panel including said phosphor in dispersed form on photostimulation with light in the wavelength range above 600 nm images with very high signal-to-noise ratio are yielded.

A very useful and preferred method for the preparation of stimulable phosphors can be found in Research Disclosure Volume 358, February 1994, p. 93, item 35841, which is incorporated herein by reference. In order to produce phosphors with a constant composition and, therefore, with a constant stimulation spectrum for use in storage phosphor panels, even in the presence of co-dopants that influence the position of the stimulation spectrum as e.g. samarium or an alkali metal, added to the raw mix of base materials in small amounts as prescribed in EP-A 0 533 234, a solution therefore has been proposed in U.S. Pat. No. 5,517,034.

Therein a method of recording and reproducing a penetrating radiation image has been proposed comprising the steps of:

(i) causing stimulable storage phosphors to absorb said penetrating radiation having passed through an object or emitted by an object and to store energy of said penetrating radiation, (ii) stimulating said phosphors with stimulating light to release at least a part of said stored energy as fluorescent light and (iii) detecting said stimulation light, characterized in that said phosphors consist of a mixture of two or more individually prepared divalent europium doped bariumfluorohalide phosphors at least one of which contains (a) co-dopant(s) which co-determine(s) the character of the stimulation spectrum of the co-doped phosphor. So in praxis a maximum in the stimulation spectrum for e.g. lithium fluxed stimulable europium activated bariumfluorohalide phosphor can be found between 520 and 550 nm, whereas for cesium fluxed phosphor its maximum is situated between 570 and 630 nm. Maxima for the stimulation spectra of said phosphors after making a mixture thereof can be found at intermediate wavelengths. The stimulation spectrum of said mixture is further characterized in that the emission intensity at 500 nm stimulation is always lower than the emission intensity at 600 nm. The broadening of the obtained stimulation spectra is a further advantage resulting from the procedure of making blends in that the storage panel in which the stimulable phosphors are incorporated is sensitive to a broad region of stimulation wavelengths in the visible range of the wavelength spectrum. As a consequence the storage panel comprising a layer with the phosphor blends described hereinbefore may offer universal application possibilities from the point of view of stimulation with different stimulating light sources. Different stimulating light sources that may be applied are those that have been described in Research Dislosure No. 308117, December 1989.

A radiographic screen according to the present invention can be prepared by the following manufacturing process.

It is clear that the choice of the stimulation light source is decisive for the choice of the AHU colorant as maximum absorption of stimulation light in the AHU by the said colorant or dye is urged.

The phosphor layer in the panel used in the present invention can be applied to the support by any coating procedure, making use of solvents for the binder of the phosphor containing layer as well as of useful dispersing agents, useful plasticizers, useful fillers and subbing or interlayer layer compositions that have been described in extenso in the EP-A 0 510 753.

Phosphor particles may be mixed with dissolved rubbery and/or elastomeric polymers, in a suitable mixing ratio in order to prepare a dispersion. Said dispersion is uniformly applied to a substrate by a known coating technique as e.g. doctor blade coating, roll coating, gravure coating or wire bar coating, and dried to form a luminescent layer fluorescing by X-ray irradiation and called hereinafter fluorescent layer. Further mechanical treatments like compression to lower the void ratio is not required within the scope of the present invention.

Dispersing agents suitable for used in order to improve the dispersibility of the phosphor particles dispersed into the coating dispersions can be found in e.g. EP-A 0 510 753 as well as a variety of additives that can be added to the phosphor layers such as a plasticizer for increasing the bonding between the binder and the phosphor particles in the phosphor layer, which may also be provided with same or another colorant. Useful plasticizers include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; polymeric plastizers, e.g. and polyesters of polyethylene glycols with aliphatic dicarboxylic acids such as polyester of triethylene glycol with adipic acid and polyester of diethylene glycol with succinic acid.

The stimulable phosphor is preferably protected against the influence of moisture by adhering thereto chemically or physically a hydrophobic or hydrophobising substance. Suitable substances for said purpose have been described e.g. in U.S. Pat. No. 4,138,361 and, more recently in EP-A's 1 286 364 and 1 286 365, wherein protection by p-xylylene polymer films for extremely moisture-sensitive alkali metal halide phosphors as those described in EP-A 1 113 458 and in PCT-filing WO 01/3156. When present in the storage panels of the present invention powdered or pulverized phosphors having same composition as described therein, are advantageously protected against moisture. So as preferred powdered or pulverized phosphors CsX:Eu stimulable phosphors are envisaged, wherein X represents a halide selected from the group consisting of Br and Cl. Such a phosphor is preferably prepared by mixing CsX with between 10 and 5 mol % of an Europium compound selected from the group consisting of $EuX'^2$, $EuX'^3$ and EuOX', X' being a member selected from the group consisting of F, Cl, Br and I; firing said mixture at a temperature above 450° C., cooling said mixture and recovering the CsX:Eu phosphor. Most preferably CsBr:Eu is envisaged as stimulable phosphor within this class of phosphors.

Additional layer(s) may be coated on the support either as a backing layer or interposed between the support and the intermediate layer, the said intermediate layer and the phosphor containing layer(s). Several of said additional layers may be applied in combination.

In the preparation of the phosphor screen having a primer layer between the support or substrate and the layer containing the phosphor(s), the primer layer is provided on the substrate apart, before coating the other layers by the method according to the present invention, already described before.

An ultrasonic treatment can be applied in order to improve the packing density and to perform de-aeration of the phosphor-binder combination. Before application of a protective coating the phosphor-binder layer may be calendered in order to improve the packing density (i.e. the number of grams of phosphor per $cm^3$ of dry coating). After applying the coating dispersion onto underlying intermediate layer arrangement as applied in the panel according to the present invention, the coating dispersion is heated slowly to dryness in order to complete the formation the phosphor layer. In order to remove air entrapped in the phosphor coating composition as much as possible, it can be subjected to an ultrasonic treatment before coating. After the formation of the phosphor layer, a protective layer is generally provided on top of the fluorescent layer.

Correlating features of roughness and thickness of the protective coating conferring to the screens of the present invention having desirable and unexpected properties of ease of manipulation and excellent image sharpness have been described in the EP-A 0 510 754. In a preferred embodiment coating of the protective layer herein proceeds by screen-printing (silk-screen printing or rotary screen printing as described in EP-A 0 510 753).

Very useful radiation curable compositions for forming a protective coating contain as primary components:

(1) a crosslinkable prepolymer or oligomer, (2) a reactive diluent monomer (3) or even combined with a polymer, soluble in the diluent monomer, and in the case of an UV curable formulation, (4) a photoinitiator Examples of suitable prepolymers for use in a radiation-curable composition applied to the storage panel according to the present invention are the following: unsaturated polyesters, e.g. polyester acrylates; urethane modified unsaturated polyesters, e.g. urethane-polyester acrylates. Liquid polyesters having an acrylic group as a terminal group, e.g. saturated copolyesters which have been provided with acryl-type end groups are described in published EP-A 0 207 257 and Radiat. Phys. Chem., Vol. 33, No. 5, 443-450 (1989). The latter liquid copolyesters are substantially free from low molecular weight, unsaturated monomers and other volatile substances and are of very low toxicity (Adhäsion 1990 Heft 12, page 12). The preparation of a large variety of radiation-curable acrylic polyesters is given in DE-A 2838691. Mixtures of two or more of said prepolymers may be used. A survey of UV-curable coating compositions is given e.g. "Coating" 9/88, p. 348–353.

When the radiation-curing is carried out with ultraviolet radiation (UV), a photoinitiator is present in the coating composition to serve as a catalyst to initiate the polymerization of the monomers and their optional cross-linking with the pre-polymers resulting in curing of the coated protective layer composition. A photosensitizer for accelerating the effect of the photoinitiator may be present. Photoinitiators suitable for use in UV-curable coating compositions belong to the class of organic carbonyl compounds, for example, benzoin ether series compounds such as benzoin isopropyl, isobutylether; benzil ketal series compounds; ketoxime esters; benzophenone series compounds such as benzophenone, o-benzoylmethylbenzoate; acetophenone series compounds such as acetophenone, trichloroacetophenone, 1,1-dichloroacetophenone, 2,2-diethoxyacetophenone, 2,2-dimethoxy-2-phenylacetophenone; thioxanthone series compounds such as 2-chlorothioxanthone, 2-ethylthioxanthone; and compounds such as 2-hydroxy-2-methylpropiophenone, 2-hydroxy-4'-isopropyl-2-methylpropiophenone, 1-hydroxycyclohexylphenylketone; etc. A particularly preferred photoinitiator is 2-hydroxy-2methyl-1-phenylpropan-1-one which product is marketed by E. MERCK, Darmstadt, Germany, under the tradename DAROCUR 1173. The above mentioned photopolymerisation initiators may be used alone or as a mixture of two or more. Examples of suitable photosensitizers are particular aromatic amino compounds as described in GB-A 1,314,556; 1,486,911; U.S. Pat. No. 4,255,513 and merocyanine and carbostyril compounds as in U.S. Pat. No. 4,282,309. When using ultraviolet radiation as curing source the photoinitiator which should be added to the coating solution will to a more or less extent also absorb the light emitted by the phosphor thereby impairing the sensitivity of the radiographic screen, particularly when a phosphor emitting UV or blue light is used. Electron beam curing may therefore be more effective.

The protective coating of the present storage panel is given an embossed structure following the coating stage by passing the uncured or slightly cured coating through the nip of pressure rollers wherein the roller contacting said coating has a micro-relief structure, e.g. giving the coating an embossed structure so as to obtain relief parts as has been described e.g. in EP-A's 455 309 and 456 318. Another suitable process for forming a textured structure in a plastic coating may proceed by means of engraved chill roll as described in U.S. Pat. No. 3,959,546.

According to another embodiment the textured or embossed structure is obtained already in the coating stage by applying the paste-like coating composition with a gravure roller or screen printing device operating with a radiation-curable liquid coating composition the Hoepplerviscosity of which at a coating temperature of 25° C. is between 450 and 20,000 mPas.

In order to avoid flattening of the embossed structure under the influence of gravitation, viscosity and surface shear the radiation-curing is effected immediately or almost immediately after the application of the liquid coating. The rheologic behavior or flow characteristics of the radiation-curable coating composition can be controlled by means of so-called flowing agents. For that purpose alkylacrylate ester copolymers containing lower alkyl (C1–C2) and higher alkyl (C6–C18) ester groups can be used as shear controlling agents lowering the viscosity. The addition of pigments such as colloidal silica raises the viscosity.

A variety of other optional compounds can be included in the radiation-curable coating composition of the present radiographic article such as compounds to reduce static electrical charge accumulation, plasticizers, matting agents, lubricants, defoamers and the like as has been described in EP-A 0 510 753. In that document a description has also been given of the apparatus and methods for curing, as well as a non-limitative survey of X-ray conversion screen phosphors, of photostimulable phosphors and of binders of the phosphor containing layer.

The edges of the screen, being especially vulnerable by multiple manipulation, may be reinforced by covering the edges (side surfaces) with a polymer material being formed essentially from a moisture-hardened polymer composition prepared according to EP-A 0 541 146.

Support materials for radiographic screens which in accordance with specific embodiments of the present invention may be, apart from the plastic films such as films of cellulose acetate, polyvinyl chloride, polyvinyl acetate, polyacrylonitrile, polystyrene, polyester, polyethylene terephthalate, polyethylene naphthalate, polyamide, polyimide, cellulose triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. As already set forth before preferred supports include polyethylene terephthalate, clear or blue colored or black colored (e.g., LUMIRROR C, type X30 supplied by Toray Industries, Tokyo, Japan), polyethylene terephthalate filled with $TiO_2$ or with $BaSO_4$. Metals as e.g. aluminum, bismuth and the like may be deposited e.g. by vaporization techniques to get a polyester support having the desired radiation-reflective properties, required for supports having reflective properties in favor of speed. These supports may have thicknesses which may differ depending on the material of the support, and may generally be between 50 and 1000 $\mu$m, more preferably between 80 and 500 $\mu$m depending on handling properties. Further may be mentioned glass supports.

Normally the screens described hereinbefore are applied for medical X-ray diagnostic applications but according to a particular embodiment the present radiographic screens may be used in non-destructive testing (NDT), of metal objects, where more energetic X-rays and $\gamma$-rays are used than in medical X-ray applications. Especially in such applications further glass and metal supports are used, the latter preferably of high atomic weight, as described e.g. in U.S. Pat. Nos. 3,872,309 and 3,389,255. According to a particular embodiment for industrial radiography the image-sharpness of the phosphor screen is improved by incorporating in the phosphor screen between the phosphor-containing layer and the support and/or at the rear side of the support an additional pigment-binder layer containing a non-fluorescent pigment being a metal compound, e.g. salt or oxide of lead, as described in Research Disclosure September 1979, item 18502.

In order to obtain a reasonable signal-to-noise ratio (S/N) the stimulation light should be prevented from being detected together with the fluorescent light emitted on photostimulation of the storage phosphor. Therefore a suitable filter means is used preventing the stimulation light from entering the detecting means, e.g. a photomultiplier tube. Because the intensity ratio of the stimulation light is markedly higher than that of the stimulated emission light, i.e. differing in intensity in the range of $10^4$:1 to $10^6$:1 (see published EP-A 0 007 105, column 5) a very selective filter should be used. Suitable filter means or combinations of filters may be selected from the group of: cut-off filters, transmission bandpass filters and band-reject filters. A survey of filter types and spectral transmittance classification is given in SPSE Handbook of Photographic Science and Engineering, Edited by Woodlief Thomas, Jr.—A Wiley-Interscience Publication—John Wiley & Sons, New York (1973), p. 264–326.

The fluorescent light emitted by photostimulation is detected preferably photo-electronically with a transducer transforming light energy into electrical energy, e.g. a phototube (photomultiplier) providing sequential electrical signals that can be digitized and stored. After storage these signals can be subjected to digital processing. Digital processing includes e.g. image contrast enhancement, spatial frequency enhancement, image subtraction, image addition and contour definition of particular image parts.

According to one embodiment for the reproduction of the recorded X-ray image the optionally processed digital signals are transformed into analog signals that are used to modulate a writing laser beam, e.g. by means of an acousto-optical modulator. The modulated laser beam is then used to scan a photographic material, e.g. silver halide emulsion film whereupon the X-ray image optionally in image-processed state is reproduced. According to another embodiment the digital signals obtained from the analog-digital conversion of the electrical signals corresponding with the light obtained through photostimulation are displayed on a cathode-ray tube. Before display the signals may be processed by computer. Conventional image processing techniques can be applied to reduce the signal-to-noise ratio of the image and enhance the image quality of coarse or fine image features of the radiograph.

EXAMPLES

While the present invention will hereinafter be described in connection with preferred embodiments thereof, it will be understood that it is not intended to limit the invention to those embodiments.

Composition of the antihalation layer (AHU):

| ingredient (manufactured by) | comparative AHU (wt %) | inventive AHU (wt %) |
|---|---|---|
| Mowilith CT5 (Hoechst) | 8.4 | 5.6 |
| Cymel 300 (Cyanamid) | 2.8 | 5.6 |
| p-toluenesulfonic acid (Riedel-de-Haen) | 0.3 | 0.4 |
| AHU colorant (AGFA-GEVAERT) | 150 ppm | 150 ppm |
| ethanol (Silbermann) | 75.2 | 70.8 |
| methylethylketone (Staub) | 13.3 | 15.9 |
| methoxypropanol (Silbermann) | 0 | 1.7 |

Mowilith CT5 is a vinylacetate-crotonic acid-copolymer; Cymel 300 is a modified melamine-formaldehyde resin (hexamethoxymethyl melamine)

Thermal curing was carried out at a temperature of at least 30 min at 90° C.

The formula of the AHU colorant has been given hereinafter.

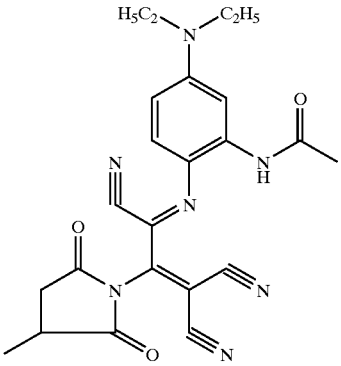

AHU colorant

Influence of thermal curing temperature on the non-migration percentage of the antihalation dye of the comparative antihalation layer (curing for 30 min), measured by immersion for 10 minutes at 25° C. of a sample (5 cm×5 cm) in a solvent mixture (50/30/20 expressed in wt % of methylcyclohexane/toluene/butylacetate: non-migration percentages have been calculated from optical densities of dye or colorant when comparing densities at a wavelength of 633 nm before and after said immersion test, measured in the AHU layer.

| Non-migration % of AHU |
|---|
| at 45° C. => 47% |
| at 70° C. => 82% |
| at 90° C. => 92% |

From the results obtained it is clear that a higher curing temperature provides an increased hardening of the AHU layer and decreases migration of the antihalation dye or AHU colorant to the AIL.

Composition of the adhesion improving layer (AIL) type 1:

| ingredient | inventive (wt %) | manufactured by |
|---|---|---|
| Vitel PE 2200B | 7.5 | Krahn Chemie |
| Desmodur N 75 | 0.6 | Bayer |
| toluene | 36.5 | Silbermann |
| methylethylketone | 55.4 | Staub |

Desmodur N 75 is an alifatic polyisocyanate (hexamethylene-1,6-diisocyanate)

Thermal curing was carried out at 60° C. for 1 hour.

Composition of the adhesion improving layer (type 2):

| ingredient | inventive (wt %) | manufactured by |
|---|---|---|
| Kraton FG1901X | 3.20 | Shell Chemicals |
| Kraton EKP-207 | 0.80 | Shell Chemicals |
| Desmodur N 75 | 0.10 | Bayer |
| Exxol 100/120 | 48.0 | Silbermann |
| toluene | 28.8 | Silbermann |
| butylacetate | 19.1 | Silbermann |

Kraton FG1901X is a functionalized styrene-ethylene/butylene styrene block copolymer (thermoplastic rubber).
Kraton EKP-207 is a hetero-telechelic polymer consisting of a primary hydroxyl functionality on one end of the polymer and epoxidized isoprene functionality at the other end.

Thermal curing was carried out at 60° C. for 1h.

Composition of the adhesion improving layer (type 3):

| ingredient | inventive (wt %) | manufactured by |
|---|---|---|
| Mowilith CT5 | 10.27 | Hoechst |
| Cymel 300 | 1.14 | Cyanamid |
| p-toluene sulfonic acid | 0.13 | Riedel-de-Haen |
| ethanol | 44.2 | Silbermann |
| methylethylketone | 42.5 | Staub |
| methoxypropanol | 1.76 | Silbermann |

Thermal curing was carried out at 90° C. for 30 min.

Composition of the adhesion improving layer (type 4):

| ingredient | inventive (wt %) | manufactured by |
|---|---|---|
| Mowilith CT5 | 9.6 | Hoechst |
| Desmodur N75 | 2.4 | Bayer |
| methylethylketone | 88 | Staub |

Thermal curing is carried out at 40° C. for 4 hours.

SUMMARY OF THE RESULTS

Degree of curing of a single layer (tests carried out in a solvent mixture of 50/30/20 methylcyclohexane/toluene/butylacetate, immersion time being 10 minutes)

| single layer | non-migration of antihalation dye (%) | solvent solubility of layer (%) |
|---|---|---|
| antihalation comparative | 92 | 1.6 |
| antihalation inventive | 98–99 | <0.1 |
| adhesion improving layer type 1 | no dye present | 3.9 |
| adhesion improving layer type 2 | no dye present | 10.1 |

-continued

| single layer | non-migration of antihalation dye (%) | solvent solubility of layer (%) |
|---|---|---|
| adhesion improving layer type 3 | no dye present | 3.5 |
| adhesion improving layer type 4 | no dye present | 7.5 |

As described in detail hereinbefore and hereinafter preferred embodiments of the current invention, it will now be apparent to those skilled in the art that numerous modifications can be made therein without departing from the scope of the invention as defined in the appending claims following the given examples.

Parameters for a single and combined two-layer system (tests for determining the non-migration % were carried out in a solvent mixture of 50/30/20 methylcyclohexane/toluene /butylacetate):

AIL = adhesion improving layer

| layer(s) between support and storage phosphor layer | cross-cut on complete panel % area damaged | non-migration % of antihalation dye through one or two-layer system |
|---|---|---|
| antihalation layer (comp.) | 50–80 | 92 |
| antihalation layer (inv.) | 50 | 98–99 |
| two-layer systems: | | |
| antihal.inv. + AIL type 1 | 20 | 90 |
| antihal.inv. + AIL type 2 | 10–20 | 97 |
| antihal.inv. + AIL type 3 | 0 | >99 |
| antihal.inv. + AIL type 4 | 0 | 99 |

Influence of Mowilith/Cymel—ratio on the degree of curing of the antihalation layer and adhesion improving layer type 3, measuring solvent solubility and the mass swelling increase by immersing for 10 minutes in a mixture of methyl-cyclohexaan/toluene/butylacetate (50/30/20 mass %) after the layer was cured for 30 minutes at 90° C.:

AIL = adhesion improving layer//AHU = antihalation (dye) layer

| Mowilith CT5 mass % | Cymel 300 layer mass % | | solvent solubility mass % | mass swelling increase in % |
|---|---|---|---|---|
| 100 | 0 | | 10.5 | 53 |
| 90 | 10 | AIL type 3 | 3.5 | 45 |
| 80 | 20 | | 2.5 | 35 |
| 75 | 25 | AHU comp. | 1.6 | 28 |
| 60 | 40 | | 0.5 | 16 |
| 50 | 50 | AHU inv. | <0.1 | 10 |
| 40 | 60 | | 2.7 | 22 |
| 25 | 75 | | 8.0 | 24 |
| 10 | 90 | | 13.5 | 25 |

As is clear from the data given above the said two layer arrangement combines the prevention of migration of antihalation dye in a screen together with an improved adhesion of the phosphor layer.

What is claimed is:

1. Radiation image storage panel, comprising a supported layer of storage phosphor particles dispersed in a binding medium, and adjacent thereto, between the said layer and a support having reflective properties, a layer arrangement of intermediate layers in between, characterized in that said layer arrangement consists of an antihalation undercoat layer containing one or more dye(s), said layer being situated more close to said support, and an adhesion improving layer situated more close to the said layer of storage phosphor particles, and wherein said adhesion improving layer is hardened to a lesser extent than said antihalation undercoat layer.

2. Radiation image storage panel according to claim 1, wherein a "cross-cut" value of not more than 20% is obtained, when applied to the said layer arrangement as described in DIN 53151 revision date October 1994.

3. Radiation image storage panel according to claim 1, wherein said undercoat layer is comprising one or more dye(s) providing in said antihalation undercoat layer an average absorption coefficient being higher in the wavelength range of the stimulating rays than in the wavelength range of the rays emitted by the stimulable phosphor upon stimulation, wherein a non-migration percentage of the antihalation dye(s) is at least 95% for the antihalation layer, and at least 90% for the layer arrangement, both having been cured for 30 min at 90° C., said percentages having been determined after immersing for 10 minutes a sample of said panel in a solvent mixture at 25° C. of methyl-cyclohexane/toluene/butyl acetate present in a 50/30/20 wt % ratio.

4. Radiation image storage panel according to claim 1, wherein the solvent solubility of the antihalation layer is less than 1%, whereas the mass swelling factor increase is less than 20%, said factor having been determined after immersing for 10 minutes at 25° C. a sample of 5×5 cm of said panel in a solvent mixture of methyl-cyclohexane/toluene/butyl acetate present in a ratio of 50/30/20 wt %.

5. Radiation image storage panel according to claim 1, wherein the solvent solubility of the adhesion improving layer is more than 3%, whereas the mass swelling factor increase is more than 20%, said factor having been determined after immersing for 10 minutes at 25° C. a sample of said panel in a solvent mixture of methyl-cyclohexane/toluene/butyl acetate present in a 50/30/20 wt % ratio.

6. Radiation image storage panel according to claim 1, wherein ratios of mass swelling factor of the antihalation undercoat layer and adhesion improving layer are in the range from at least 11:10 up to 10:1, said factor having been determined after immersing a sample of 5 cm×5 cm of the storage phosphor panel for 10 minutes at 25° C. in a solvent mixture of methyl-cyclohexane/toluene/butyl acetate in a 50/30/20 wt % ratio.

7. Radiation image storage panel according to claim 1, wherein ratios of mass swelling factor of the antihalation undercoat layer and adhesion improving layer are in the range from at least 2:1 up to 5:1, said factor having been determined after immersing a sample of 5 cm×5 cm of the storage phosphor panel for 10 minutes at 25° C. in a solvent mixture of methyl-cyclohexane/toluene/butyl acetate in a 50/30/20 wt % ratio.

8. Method of preparing a radiation image storage panel according to claim 1, wherein said layer arrangement has been coated by means of a coating technique selected from the group consisting of doctor blade or dip-coating, screen printing and spraying, wherein curing has been performed by means of a curing technique selected from the group consisting of thermal curing, UV/EB-curing and solvent evaporation.

9. Radiation image storage panel according to claim 1, wherein in said layer arrangement the antihalation undercoat layer and the adhesion improving layer together have a thickness of from 0.5 $\mu$m up to 20 $\mu$m.

10. Radiation image storage panel according to claim 9, wherein a "cross-cut" value of not more than 20% is obtained, when applied to the said layer arrangement as described in DIN 53151 revision date October 1994.

11. Radiation image storage panel according to claim 9, wherein said undercoat layer is comprising one or more dye(s) providing in said antihalation undercoat layer an average absorption coefficient being higher in the wavelength range of the stimulating rays than in the wavelength range of the rays emitted by the stimulable phosphor upon stimulation, wherein a non-migration percentage of the antihalation dye(s) is at least 95% for the antihalation layer, and at least 90% for the layer arrangement, both having been cured for 30 min at 90° C., said percentages having been determined after immersing for 10 minutes a sample of said panel in a solvent mixture at 25° C. of methyl-cyclohexane/toluene/butyl acetate present in a 50/30/20 wt % ratio.

12. Radiation image storage panel according to claim 9, wherein the solvent solubility of the antihalation layer is less than 1%, whereas the mass swelling factor increase is less than 20%, said factor having been determined after immersing for 10 minutes at 25° C. a sample of 5×5 cm of said panel in a solvent mixture of methyl-cyclohexane/toluene/butyl acetate present in a ratio of 50/30/20 wt %.

13. Radiation image storage panel according to claim 9, wherein the solvent solubility of the adhesion improving layer is more than 3%, whereas the mass swelling factor increase is more than 20%, said factor having been determined after immersing for 10 minutes at 25° C. a sample of said panel in a solvent mixture of methyl-cyclohexane/toluene/butyl acetate present in a 50/30/20 wt % ratio.

14. Radiation image storage panel according to claim 9, wherein ratios of mass swelling factor between the adhesion improving layer and antihalation undercoat layer are in the range from at least 11:10 up to 10:1, said factor having been determined after immersing a sample of 5 cm×5 cm of the storage phosphor panel for 10 minutes at 25° C. in a solvent mixture of methyl-cyclohexane/toluene/butyl acetate in a 50/30/20 wt % ratio.

15. Radiation image storage panel according to claim 9, wherein ratios of mass swelling factor between the adhesion improving layer and antihalation undercoat layer are in the range from at least 2:1 up to 5:1, said factor having been determined after immersing a sample of 5 cm×5 cm of the storage phosphor panel for 10 minutes at 25° C. in a solvent mixture of methyl-cyclohexane/toluene/butyl acetate in a 50/30/20 wt % ratio.

16. Method of preparing a radiation image storage panel according to claim 9, wherein said layer arrangement has been coated by means of a coating technique selected from the group consisting of doctor blade or dip-coating, screen printing and spraying, wherein curing has been performed by means of a curing technique selected from the group consisting of thermal curing, UV/EB-curing and solvent evaporation.

17. Radiation image storage panel according to claim 1, wherein in said layer arrangement the antihalation undercoat layer and the adhesion improving layer together have a thickness of from 1 $\mu$m up to 10 $\mu$m.

18. Radiation image storage panel according to claim 17, wherein a "cross-cut" value of not more than 20% is obtained, when applied to the said layer arrangement as described in DIN 53151 revision date October 1994.

19. Radiation image storage panel according to claim 17, wherein said undercoat layer is comprising one or more dye(s) providing in said antihalation undercoat layer an average absorption coefficient being higher in the wavelength range of the stimulating rays than in the wavelength range of the rays emitted by the stimulable phosphor upon stimulation, wherein a non-migration percentage of the antihalation dye(s) is at least 95% for the antihalation layer, and at least 90% for the layer arrangement, both having been cured for 30 min at 90° C., said percentages having been determined after immersing for 10 minutes a sample of said panel in a solvent mixture at 25° C. of methyl-cyclohexane/toluene/butyl acetate present in a 50/30/20 wt % ratio.

20. Radiation image storage panel according to claim 17, wherein the solvent solubility of the antihalation layer is less than 1%, whereas the mass swelling factor increase is less than 20%, said factor having been determined after immersing for 10 minutes at 25° C. a sample of 5×5 cm of said panel in a solvent mixture of methyl-cyclohexane/toluene/butyl acetate present in a ratio of 50/30/20 wt %.

21. Radiation image storage panel according to claim 17, wherein the solvent solubility of the adhesion improving layer is more than 3%, whereas the mass swelling factor increase is more than 20%, said factor having been determined after immersing for 10 minutes at 25° C. a sample of said panel in a solvent mixture of methyl-cyclohexane/toluene/butyl acetate present in a 50/30/20 wt % ratio.

22. Radiation image storage panel according to claim 17, wherein ratios of mass swelling factor between the adhesion improving layer and antihalation undercoat layer are in the range from at least 11:10 up to 10:1, said factor having been determined after immersing a sample of 5 cm×5 cm of the storage phosphor panel for 10 minutes at 25° C. in a solvent mixture of methyl-cyclohexane/toluene/butyl acetate in a 50/30/20 wt % ratio.

23. Radiation image storage panel according to claim 17, wherein ratios of mass swelling factor between the adhesion improving layer and antihalation undercoat layer are in the range from at least 2:1 up to 5:1, said factor having been determined after immersing a sample of 5 cm×5 cm of the storage phosphor panel for 10 minutes at 25° C. in a solvent mixture of methyl-cyclohexane/toluene/butyl acetate in a 50/30/20 wt % ratio.

24. Method of preparing a radiation image storage panel according to claim 17, wherein said layer arrangement has been coated by means of a coating technique selected from the group consisting of doctor blade or dip-coating, screen printing and spraying, wherein curing has been performed by means of a curing technique selected from the group consisting of thermal curing, UV/EB-curing and solvent evaporation.

25. Radiation image storage panel according to claim 1, wherein said support is a polyethylene terephthalate support having reflective properties in that a light-reflecting layer between support and phosphor layer is present.

26. Radiation image storage panel according to claim 25, wherein a "cross-cut" value of not more than 20% is obtained, when applied to the said layer arrangement as described in DIN 53151 revision date October 1994.

27. Radiation image storage panel according to claim 1, wherein said support is a polyethylene terephthalate support having reflective properties in that light-reflecting particles are incorporated into the support.

28. Radiation image storage panel according to claim 27, wherein a "cross-cut" value of not more than 20% is obtained, when applied to the said layer arrangement as described in DIN 53151 revision date October 1994.

* * * * *